United States Patent [19]

Laimböck

[11] Patent Number: 5,014,510

[45] Date of Patent: May 14, 1991

[54] EXHAUST SYSTEM, PARTICULARLY FOR TWO-STROKE CYCLE INTERNAL COMBUSTION ENGINES

[76] Inventor: Franz Laimböck, Waldsdorfberg 86, A-8051 Graz-Thal, Austria

[21] Appl. No.: 520,235

[22] Filed: May 8, 1990

[30] Foreign Application Priority Data

Jun. 1, 1989 [AT] Austria ..... 1330/89

[51] Int. Cl.[5] ..... F01N 3/18

[52] U.S. Cl. ..... 60/299; 60/302; 422/180

[58] Field of Search ..... 60/302, 299; 422/178, 422/180, 176, 177

[56] References Cited

U.S. PATENT DOCUMENTS

| | | | |
|---|---|---|---|
| 3,948,046 | 4/1976 | Davidson | 60/299 |
| 4,195,063 | 3/1980 | Iwaoka | 422/180 |
| 4,220,625 | 9/1980 | Toh | 422/180 |

FOREIGN PATENT DOCUMENTS

| | | | |
|---|---|---|---|
| 32223 | 3/1978 | Japan | 60/299 |
| 117120 | 10/1978 | Japan | 422/180 |
| 164714 | 12/1980 | Japan | 422/180 |

*Primary Examiner*—Douglas Hart
*Attorney, Agent, or Firm*—Kurt Kelman

[57] ABSTRACT

In an exhaust system, particularly for two-stroke cycle internal combustion engines, at least that portion which adjoins the internal combustion engine consists of two joined shell sections made of sheet metal and contains a catalytic converter. In order to simplify the manufacture and to ensure that the gas dynamics will not adversely be affected, the catalytic converter is constituted by a central partition, which extends between the sheet metal shell sections in the direction of flow of the exhaust gases and is provided with a catalytic coating and is optionally apertured.

11 Claims, 2 Drawing Sheets

1
2
3
4
5
6
7
8
9
10
11
II

EXHAUST SYSTEM, PARTICULARLY FOR TWO-STROKE CYCLE INTERNAL COMBUSTION ENGINES

BACKGROUND OF THE INVENTION

1. Field of the Invention

This invention relates to an exhaust system, particularly for two-stroke cycle internal combustion engines, in which at least that portion which adjoins the internal combustion engine consists of two joined shell sections made of sheet metal and contains a catalytic converter.

2. Description of the Prior Art

Such exhaust systems have the advantage that their manufacture is rather simple and inexpensive. In exhaust systems comprising a catalytic converter for decreasing the emission of polluants in the exhaust gases it is difficult to ensure that the catalytic converter will be lighted off quickly, e.g., in case of a cold start, and that the catalytic converter will have a long service life even in case of a prolonged operation of the engine under full load although in such an operation the catalytic converter will be heated to high temperatures, which may damage the catalytic converter if the elevated temperatures are maintained for a long time.

It is already known to provide a main catalytic converter, which is preceded by a preliminary catalytic converter, which should be disposed as close as possible to the cylinder of the internal combustion engine so that the high temperatures occurring adjacent to the cylinder will cause the preliminary catalytic converter to be lighted off quickly and the main catalyst can then be installed in the exhaust system in a downstream part thereof, which is less important from the aspect of gas dynamics. In known exhaust systems the preliminary catalyst is designed to extend substantially throughout the cross-section of the exhaust system adjacent to said preliminary catalyst although that arrangement has the disadvantage that the dynamics will adversely be affected to a high degree so that the output power of the engine will be reduced.

SUMMARY OF THE INVENTION

It is an object of the invention so to improve the exhaust system of the kind described first hereinbefore that a very simple design is obtained and undesired effects on the gas dynamics need not be feared even if the catalytic converter is arranged very close to the internal combustion engine so that it will be lighted off quickly owing to the high temperatures occurring in that region.

The object set forth is accomplished in accordance with the invention in that the catalytic converter is constituted by a central partition, which extends between the sheet metal shell sections in the direction of flow of the exhaust gases and is provided with a catalytic coating and is optionally apertured.

Such a central partition does not constitute a fixture which would disturb the gas dynamics and can readily be installed in the same operation in which the two sheet metal shell sections of the exhaust system are joined. In motors which are expected to meet less stringent requirements regarding the decrease of the emission of polluants in the exhaust gases, it will be permissible to provide only such catalytic converter. If more stringent requirements are to be met by the internal combustion engine regarding the emission of polluants in the exhaust gases the catalytic converter which in accordance with the invention is constituted by a central partition will be succeeded by a conventional main catalyst so that the central partition serves only as a preliminary catalytic converter and will extend so close to the exhaust gas outlet of the cylinder that the preliminary catalytic converter will be lighted off very quickly. Any pressure difference between the two halves of the cross-section of the exhaust system on opposite sides of the central partition will be alleviated through said apertures. The exhaust system in accordance with the invention is particularly suitable for use with two-stroke cycle internal combustion engines comprising a curved pipe which constitutes a diffuser.

In accordance with a further feature of the invention the central partition which constitutes the catalytic converter is provided with spaced apart lugs, which protrude from the side edges of the partition and are retained between flanges which are formed on the sheet metal shell sections and have been joined preferably by welding. Such a design will allow for different thermal expansions, which must be expected because the central partition will obviously assume much higher temperatures than the sheet metal shell sections.

It will also be particularly desirable to provide the sheet metal shell sections on the outside with an insulating covering, which preferably consists of a sheath and of an insulating layer between said sheath and the sheet metal section, and said insulating covering may be welded to the flanges of the sheet metal shell sections. In that case the transfer of heat to the outside and the emission of noise will be reduced. During the manufacture of that part of the system the insulating covering can be attached by roller welding in the operation in which the sheet metal shell sections are joined and the central partition can be installed at the same time.

DETAILED DESCRIPTION OF THE PREFERRED EMBODIMENTS

Figures 1, 2:
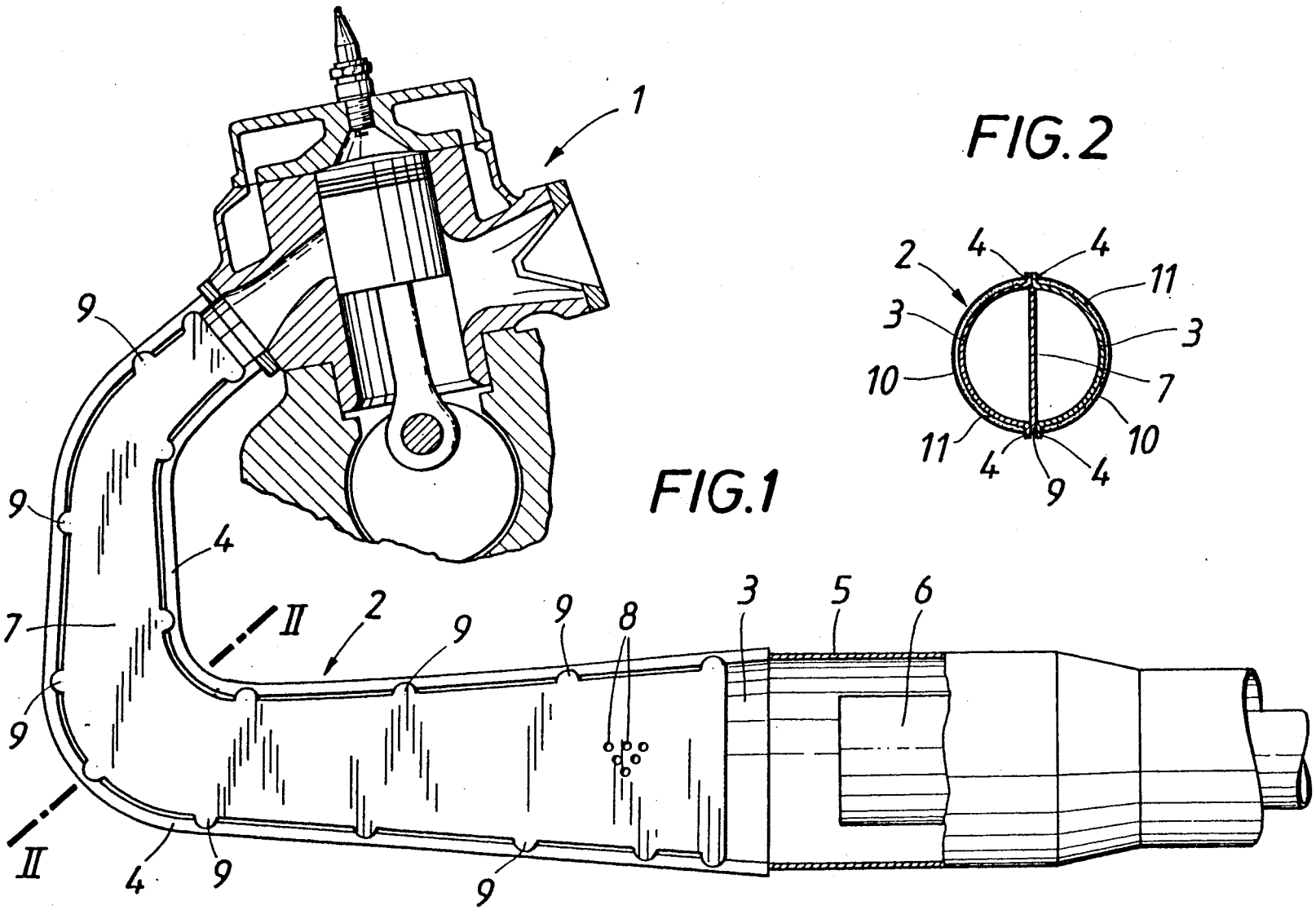
FIG. 1 is a view showing partly in section those parts of an exhaust system of a two-stroke cycle internal combustion engine which are essential for the invention.
FIG. 2 is a transverse sectional view taken on line II—II in FIG. 1.

Illustrated embodiments of the invention will now be described more in detail with reference to the drawing.

A two-stroke cycle internal combustion engine 1 is provided with an exhaust system, which comprises a part 2, which adjoins the internal combustion engine 1 and consists of a knee-shaped diffuser 2, which is composed of two sheet metal shell sections 3. Each shell section 3 has longitudinal edge flanges 4, at which the shell sections 3 have been joined by welding. The part 2 of the exhaust system is succeeded by an intermediate part 5, which contains a main catalyst 6. A preliminary catalyst is constituted by a central partition 7, which extends between the two shell sections 3 in the direction of flow and is provided with a catalytic coating on both broadsides. The partition 7 may optionally be formed with apertures 8, which may alternatively consist of slots.

To allow for a differential thermal expansion of the central partition 7 and the two sheet metal sections 3, the central partition 7 is held in position only by spaced apart lugs 9, which are provided on the longitudinal side edges of the partition 7 and extend between the flanges 4 of the shell sections.

As is indicated in FIG. 2, the section 2 of the plant may be provided with an external insulating covering, which consists of a sheath 10 and of an insulating layer 11 on the inside of the sheath. The insulating covering 10, 11 is welded to the flanges 4 of the shell sections.

Figure 4:
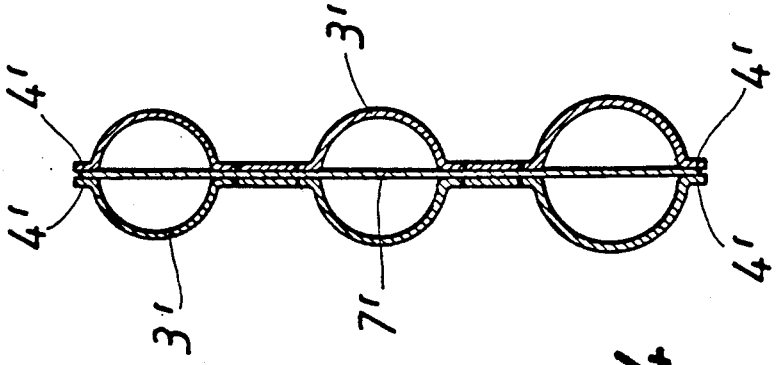
FIG. 4 is a transverse sectional view taken on line IV—IV in FIG. 3 and showing the entire system.
Figure 3:
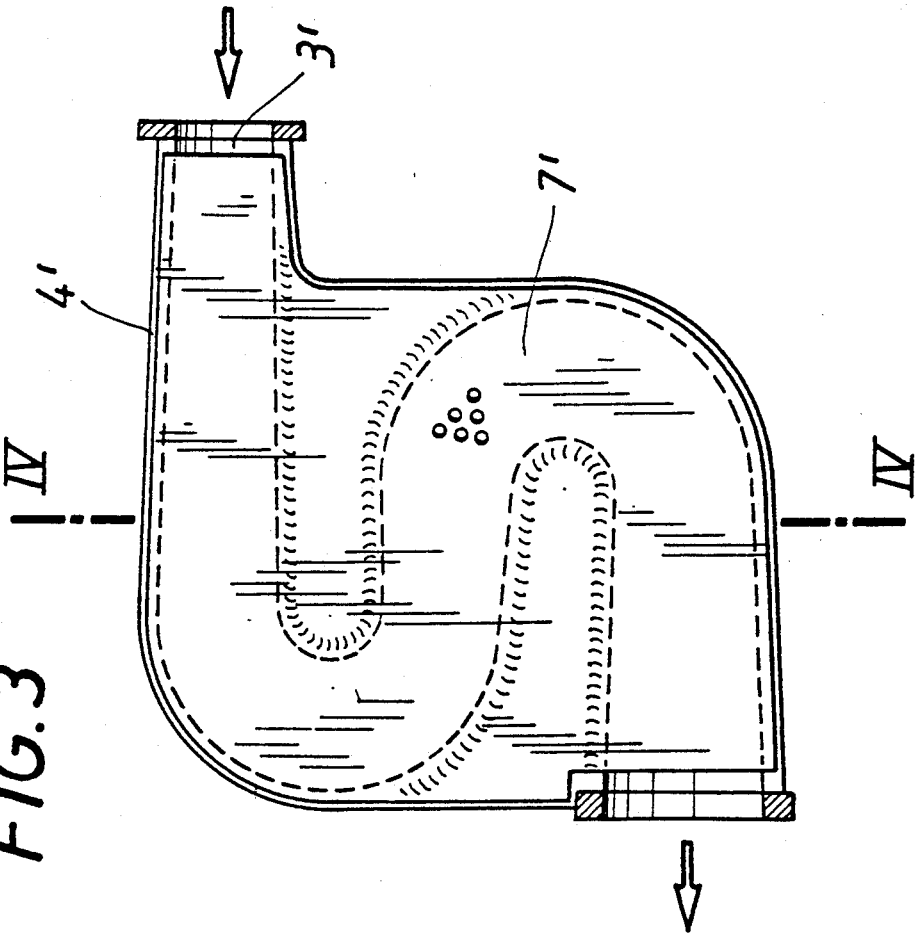
FIG. 3 is an elevation showing one half of a simple exhaust system having no main catalyst.

In FIGS. 3 and 4 a diffuser is shown which is curved approximately in S-shape and consists of two sheet metal shell sections 3'. The catalyst 7' is constituted by a central partition, which extends through all parts of the S-shaped diffuser. Alternatively, the central partition 7' might consist of separate sections in respective portions of the S-shaped diffuser.

The exhaust system in accordance with the invention may comprise diffusers which have a three-dimensional curvature, provided that said diffusers are composed of length sections which are angularly offset and that the central partition does not extend in the diffuser in a single plane.

I claim:

1. In an exhaust gas system for connection to an exhaust gas outlet of an internal combustion engine, which system comprises a portion which is adapted to be connected to said exhaust gas outlet and consists of two sheet metal sections, which are connected by joints to form a shell having an inlet end and an outlet end, and a catalytic converter contained in said shell, the improvement residing in that said converter consists of a partition, which extends between said two shell sections in the direction from said inlet end to said outlet end and is coated with catalytic material.

2. The improvement set forth in claim 1, wherein said partition bisects the interior of said shell.

3. The improvement set forth in claim 1 as applied to an exhaust system for connection to an exhaust gas outlet of a two-stroke cycle internal combustion engine.

4. The improvement set forth in claim 1, wherein said partition is formed with apertures.

5. The improvement set forth in claim 1, wherein said partition is provided with spaced apart lugs, which extend through and are retained in said joints.

6. The improvement set forth in claim 5, wherein said joints are welded joints.

7. The improvement set forth in claim 5, wherein said sheet metal sections are provided with longitudinal edge flanges, which are connected to form said joints, and said lugs extend through said joints between said edge flanges.

8. The improvement set forth in claim 1 as applied to an exhaust system which comprises an upstream preliminary catalytic converter and a downstream main catalytic converter, wherein said preliminary catalytic converter is constituted by said partition.

9. The improvement set forth in claim 8, wherein said shell is succeeded by tubular structure which contains said main catalytic converter.

10. The improvement set forth in claim 1, wherein said shell sections are provided with longitudinal edge flanges, which are welded together to form said joints and each of said shell sections is provided on the outside with an insulating covering, which is welded to said edge flanges.

11. The improvement set forth in claim 10, wherein said insulating covering comprises a sheath and an insulating layer on the inside of said sheath.

* * * * *